United States Patent [19]

Honda et al.

[11] Patent Number: 5,001,046

[45] Date of Patent: Mar. 19, 1991

[54] SILVER HALIDE PHOTOGRAPHIC LIGHT-SENSITIVE MATERIAL

[75] Inventors: Chika Honda; Haruhiko Sakuma, both of Hino, Japan

[73] Assignee: Konica Corporation, Tokyo, Japan

[21] Appl. No.: 467,320

[22] Filed: Jan. 18, 1990

Related U.S. Application Data

[63] Continuation of Ser. No. 243,443, Sep. 12, 1988, abandoned.

[30] Foreign Application Priority Data

Sep. 14, 1987 [JP] Japan ..... 62-230702

[51] Int. Cl.[5] ..... G03C 1/38

[52] U.S. Cl. ..... 430/567; 430/642; 430/963

[58] Field of Search ..... 430/567, 642, 963

[56] References Cited

U.S. PATENT DOCUMENTS 4,030,924 6/1977 Hofman ..... 430/963
4,766,058 8/1988 Sampei et al. ..... 430/567
4,801,526 1/1989 Yoshida et al. ..... 430/567
4,835,095 5/1989 Ohashi et al. ..... 430/567

FOREIGN PATENT DOCUMENTS 0147854 7/1985 European Pat. Off. .
0264954 4/1988 European Pat. Off. .

*Primary Examiner*—Hoa Van Le
*Attorney, Agent, or Firm*—Jordan B. Bierman

[57] ABSTRACT

A sheet of silver halide photographic light-sensitive material is disclosed, which is suitable for an ultra-rapid processing and improved on decreased fog due to corner cutting the sheet. The sheet of photographic material is comprised of a light-sensitive layer, provided on a support, containing a silver halide grain composed of at least two phases and the silver iodide content of outermost phase is at least 1 mol % lower than that of inside phase contiguous to said outermost phase, and 10% to 100% of surface area of said silver halide grain is occupied with (111) face, and the total gelatin amount of component layers on the same side of the support including said light-sensitive layer is within the range of from 2.0 g/m$^2$ to 3.5 g/m$^2$.

10 Claims, 2 Drawing Sheets

SILVER HALIDE PHOTOGRAPHIC LIGHT-SENSITIVE MATERIAL

This application is a continuation, of application Ser. No. 243,443, filed Sept. 12, 1988 now abandoned.

FILED OF THE INVENTION

This invention relates to a sheet-form photographic light-sensitive material. More particularly, the invention relates to a sheet-form silver halide photographic light-sensitive material which is capable of inhibiting the occurrence of a pressure fog that is otherwise likely to occur when it is subjected to the so-called corner cutting to have its corners cut to an obtuse angled or rounded configuration. The sheet-form photographic light-sensitive material in accordance with the invention can be advantageously used as such for ultra-rapid processing, a process in which it is processed by an automatic developing machine in a period of time of 20 seconds to less than 60 seconds.

BACKGROUND OF THE INVENTION

A sheet-form photographic light-sensitive material, if it has a large surface area, may become bent in the course of being handled, in which case the bent portion will be developed black to give an unsightly effect to the developed image. Oftentime, therefore, a thicker support is used to provide greater stiffness in order to ensure that the photographic light-sensitive material is less subject to bending. However, where such support is used, it is likely to hurt hand or the like portion because of its stiffness, if the corners remain right-angled. Therefore, it is desirable to effect corner cutting so as to give an abtuse angled or rounded configuration to the corners, thereby providing improved safety characteristics for handling purposes.

In the stage of corner cutting, usually a multiplicity of sheet-form films are placed one over another and guillotined by a circular cutter blade, for example, so that the films are simultaneously cut at their corners. In this case, lowermost ones of the films are subject to pressure from a cutting bed, which is often a cause of a fog forming along a cut corner line after development that may render the developed image unsightly and aversely affect the commercial value of a target product.

It may be noted in this connection that while silver halide grains having not less than 10% of face having plane index of (111), (herein after refferred to as (111) face) are advantageous because of their high sensitivity, a light-sensitive material using silver halide grains of such type is likely to involve aforesaid trouble. It is also noted that where a layer including a light-sensitive silver halide has a gelatin content of 2.0–3.5 g/m$^2$, high sensitivity is obtainable and such rapid processing is possible as, for example, development by an automatic developing machine in a period of time of 20 seconds to less than 60 seconds, but on the other hand, such trouble as aforesaid is likely to occur.

Recently, more rapid processing of a light-sensitive material is required, or in other words it is required that the amount of processing in a given period of time be increased. For example, in the area of medical X-ray films, following a rapid increase in the frequency of diagnostic tests due to increased public awareness of the needs for periodic health examination, and in view of increased number of inspection items required for more accurate diagnosis, which in turn requires X-ray photos to be taken in a greater number, on one hand, and of the necessity of the diagnosis results being informed of the examinant as promptly as possible, on the other hand, it is strongly demanded that development be made more rapidly than ever for diagnostical purposes. More particularly, in the case of vasography, in-operation photography, etc., it is essentially required that photos taken be examined as promptly as possible, and in order to meet such medical requirements, it is necessary to promote diagnostical automation (automation in photographing, transportation, etc.) and also to perform X-ray film processing more rapidly. As a light-sensitive material which can meet the requirements for such rapid processing, there has been proposed one of aforesaid type having a gelatin content 2.0–3.5 g/m$^2$, but such light-sensitive material has a diadvantage that it is liable to the occurrence of such trouble due to corner cutting as above mentioned.

SUMMARY OF THE INVENTION

It is a primary object of the invention to provide a sheet-form photographic light-sensitive material which is highly sensitive, and which can inhibit the formation of a pressure fog along cut corner lines formed when corner cutting is effected with respect to the light-sensitive material so as for its corners to be cut to an obtuse angled or rounded configuration and also can inhibit the formation of such pressure fog when the light-sensitive material is subjected to rapid processing, for example, development in an automatic development machine in a period of time of 20 seconds to less than 60 seconds.

The foregoing object can be accompolished by a sheet of silver halide photographic light-sensitive material comprising a light-sensitive layer, provided on a support, containing a silver halide grain composed of at least two phases and the silver iodide content of outermost phase is at least 1 mol % lower than that of inside phase contiguous to the outermost phase, and 10% to 100% of surface area of the silver halide grain is occupied with (111) face, and the total gelatin amount of component layers on the same side of the support including the light-sensitive layer is within the range of from 2.0 to 3.5 g/m$^2$. (The above silver halide grains to be hereinafter sometimes referred to as "silver halide grains according to the invention).

DETAILED DESCRIPTION OF THE INVENTION

Figure 1:
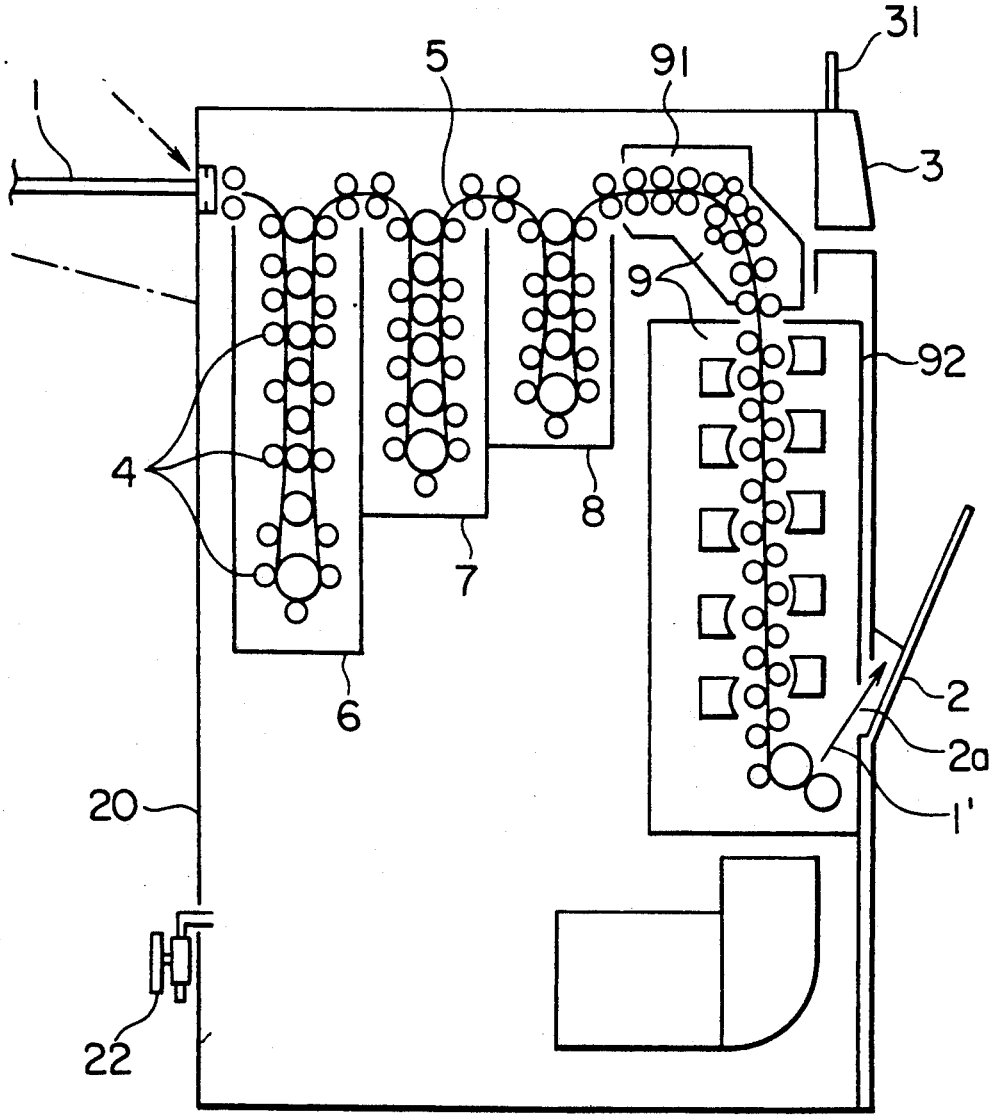
FIG. 1 is a schematic diagram showing by way of example an automatic developing machine employed in examples illustrative of the invention.

The invention will now be described in further detail.

The silver halide grains according to the invention, insofar as they contain silver iodide, may be of any composition with respect to other halogen components, such as, for example, silver iodobromide and silver chloriodobromide. The grains should preferably contain a mean silver iodide content of not more than 8 mol % relative to the whole of the grains. The grains according to the invention have a layer construction consisting of not less than two phases, that is, an internal nucleus (an innermost portion) and at least one layer or shell covering same. If the grains are of three or more layer construction, the difference in silver iodide content between the inner nucleus and an adjacent layer is preferably not less than 1 mol %, the inner nucleus is smaller in such content. In a layer having a highest silver iodide content, its silver iodide content should preferably be 10 mol % to 40 mol %. The inner nucleus and an outermost layer may or may not contain silver iodide. The conpositional distribution of these silver iodide contents can be ascertained by X-ray diffractometry.

Size of silver halide grain is preferably from 0.1 μm to 3.0 μm, more preferably from 0.2 μm to 2.0 μm.

In the case where the silver halide grains are of the so-called normal crystal form, if (111) face accounts for a proportion of more than 10% but less than 100% of a total area of (111) face and (100) face, the grains are tetradecahedral, and if (111) face accounts for 100%, the grains are octahedral. When the grains are of twin crystal form, (111) face accounts for 100%. A method of determining such ratio of surface having a specific plane index is described in a report by Akira HIRATA, in "Bulletin of Society of Science and Photography Japan", No. 13 (1963), pp 5–15.

For the purpose of obtaining grains according to the invention, a processing mode in which during growth of grains in the course of silver halide emulsion formation and prior to chemical sensitization, pAg of a mother liquid containing protective colloid is at least 10.5 or more can be advantageously employed. Especially preferably, grains under growth are allowed to pass at least once through an pAg atmosphere of 11.5 or more in which bromide ions are very excessively present. By increasing the area of (111) face in this way for rounding the grains, it is possible to further enhance the effectiveness of the invention. According to the invention, grains having a (111) face proportion which represents not less than 10% of a total surface area are employed.

In this case, the increment in the area of (111) face (an increase over the area of (111) face of the grains prior to their passage through aforesaid pAg atmosphere of 10.5 or more) is preferably not less than 10%, more preferably 10–20%.

By allowing grains during their growth prior to chemical sensitization to pass at least one through an atmosphere in which pAg of the mother liquid is at least 10.5 or more, it is possible to easily determine, according to the Hirata method of measurement, whether there has been a gain of more than 5% in the area of (111) face.

For this purpose, the timing for use of aforesaid pAg value is preferably after about two thirds of a total required silver adding have been added and before the stage of desalination which is usually carried out prior to chemical sensitization. This is because such timing is convenient for the purpose of obtaining a monodispersed emulsion of narrow grain size distribution.

Ripening in an atmosphere in which pAg is at least 10.5 is preferably carried out for not less than 2 minutes.

Through such pAg control as above said the area of (111) face is increased and grains become round-configured, and thus it is possible to obtain grains having a (111) face area accounting for not less than 10% of a total surface area of the grains.

In order to remove soluble salts from an emulsion after precipitation forming or after physical repening, a noodle washing method comprising getation of gelatin, or a precipitation method (flocculation method) utilizing inorganic salts, anionic surface active agents, anionic polymers (such as polystyrene sulfonate), or gelatin derivatives (such as acylated gelatin and carbamoylated gelatin) may be employed. The step of removing soluble salts may be omitted.

In the light-sensitive material of the invention, emulsions containing silver halide grains according to the invention (which may be hereafter sometimes referred to as an emulsion or emulsions according to the invention) may be used either in one kind alone or in a combination of several kinds.

Emulsions used in the light sensitive material of the invention are preferably subjected to gold sensitization, sulfur sensitization, or reduction sensitization. It is also desirable to use these types of sensitization in combination.

That is, sulfur sensitization in which sulfur-containing compounds reactable with active silver gelatinate such as thio sulfate, thioureas, mercapto compounds, and rhodanines, are used, reduction sensitization in which reducing substances such as stannous salts, amines, hydrazaine derivatives, formamidine sulfinc acid, and silane compounds, are used, or noble metal sensitization in which noble metal compounds e.g., gold complex salt, and complex salts of metals belonging to group VIII of Periodic Table, such as Pt, Ir, and Pd, are used, may be embloyed either independently or in combination.

Particular examples of these methods are found in the following publications. That is, methods of sulfur sensitization are described in the specifications of U.S. Pat. Nos. 1,574,944; 3,410,689; 2,278,947; 2,728,668; and 3,656,955. Methods of reduction sensitization are disclosed in U.S. Pat. Nos. 2,983,609; 2,419,974; and 4,054,458. Method of noble metal sensitization are disclosed in U.S. Pat. Nos. 2,599,083 and 2,448,060, and British Patent No. 618,061.

In the practice of the present invention, internal latent image type silver halide grains as described in Japanese Examined Patent Publication No. 2086/1966 and surface latent image type silver halide grains may be used in combination.

The sheet-form silver halide photographic light-sensitive material of the present invention can be advantageously applied to those in which at least one corner has an obtuse-angled or rounded configuration. Such corner configuration is usually formed by corner cutting, and in this connection it is particularly mentioned that the light-sensitive material of the invention is highly resistant to pressure due to corner cutting or otherwise. It is preferable that a corner portion has a rounded configuration, such as circular or ellipsoidal. A linearly cut corner is also acceptable, but in this case the cut configuration should preferably comprise at least two cut lines.

In the silver halide light-sensitive material of the invention, the amount of gelatin in photographic structural layers on the side on which a light-sensitive silver halide emulsion layer is present is within the range of 2.0–3.5 g/m$^2$. The term "phtographic structural layers" refers to all layers including a light-sensitive silver halide containing layer or layers which are present on one surface of a support, including a cover layer and an intermediate layer, and said amount of gelatin means a total amount of gelatin in these layers. If the amount of gelatin is less than 2.0 g/m$^2$, there is much possibility of fog occurrence along the cut corner portions, and even the grains according to the invention cannot be of effective use. If the amount of gelatin is in excess of 3.5 g/m$^2$, there will be noticeable drop in sensitivity.

The amount of gelatin is more preferably 2.40–3.30 g/m$^2$, still more preferably 2.50–3.15 g/m$^2$.

The silver halide light-sensitive material according to the invention can be effectively used for ultra-rapid processing with development time limited to a period of 20 seconds to less than 60 seconds.

The silver halide photographic light-sensitive material can be photographically processed based on a conventional method.

There is interrelation between a developing temperature and developing time, wherein these two factors are dependent upon a total processing time. According to the invention, these factors are, for example, 30° to 40° C., and 6 to 20 seconds.

The pH level of a developer solution is predetermined so that the light-sensitive material may exhibit intended density and contrast. The preferred pH is within a range of approx. 9 to 11, in particular, 9.8 to 10.6.

A fixer used in the fixing process is an aqueous solution containing, for example, thiosulfate salt, and water-soluble aluminum compound, and whose pH is preferably within a range of approx. 3.5 to 5.0 (20° C). According to the technique of the invention, a stop process may be provided following the developing process. However, automatic developing machines of a roller transporting type usually lack stop process, and, therefore, a developer is mixed with a fixer, thereby the pH of the fixer increases. For this reason, the preferred initial pH level of the fixer is within a range of approx. 3.6 to 4.7 (20° C.).

Fixing agents commonly used are ammonium thiosulfate, and sodium thiosulfate. From the viewpoint of a fixing speed, ammonium sulfate is particularly advantageous. Amount of the fixing agent used can be arbitrarily changed, and usually within a range of approx. 0.1 to 5 mol/l.

The fixing solution can incorporate water soluble aluminum salt that principally serves as a hardener. This type of salts are compounds as hardeners possibly used in an acid hardening fixer solution, and are typified by aluminum chloride, aluminum sulfate, and potassium alum. The preferred fixing temperature and fixing time according to the invention are, respectively, 20° to 35° C., and 4 to 15 seconds.

The photographic sensitive material undergone developing and fixing is usually washed with water, and then, dried. Washing is performed to substantially eliminating silver salt that has been dissolved by fixing, and is performed at approx. 20° to 50° C., for 5 to 12 seconds. Drying is performed at approx. 40 to 100° C. A drying time can be varied based on environmental conditions, and is usually approx. 5 to 15 seconds.

In this specification, "ultra-rapid processing" means such processing that a total period of time beginning from the insertion of the front end of a film into an automatic developing machine and up to the front end leaving a drying portion of the machine after passage of the film through development bath, interfacing portion, fixing bath, interfacing portion, washing bath, interfacing portion, and drying portion (in other words, the quotient of the total length of the processing line (m) divided by the line transport velocity (m/sec)) is 20 seconds to less than 60 seconds. The reason, why the time for passage through the interfacing portions is included in the total period of time is that as is well known in the art, it can be regarded that processing is virtually in progress at each interfacing portion because liquid from the previous stage is present in a gelatin layer, thereby swelling it.

In the specification of Japanese Patent Examined Publication No. 47045/1976 there is a statement on the importance of the amount of gelatin in rapid processing, but in this particular case, the total processing time including time for passage through interfacing portions is 60 to 120 seconds. With such length of processing time, however, it is impossible to meet recent requirements for ultra-rapid processing.

When using the emulsion(s) according to the invention, or when forming an emulsion layer by using the emulsion and other type of emulsion in combination as required, the emulsion layer may be formed by using two or more kinds of emulsions having substantially different photographic characteristics, for example, two to six kinds of silver halide emulsions. The expression "substantially different photographic characteristics" means that of various photographic characteristics, such as sensitivity, gradation, color-sensitivity, image tone, developability, image sharpness, and graininess, at least sensitivity and gradation are different.

It is possible to arrange so that separate emulsion layers individually contain emulsions having such different photographic characteristics.

The silver halide emulsions useful for the purpose of the invention may be either monodispersed or multidispersed, or may be a mixture thereof.

The silver halide photographic light-sensitive material of the invention is preferably hardened by addition of a hardner, from the view points of graininess and drying performance, so that the time in which the silver halide grains separate from the support is not less than 10 minutes, preferably not less than 15 minutes when the photographic material is immersed, without agitation, in an aqueous solution of 1.5 wt % of sodium hydroxide at 50° C.

When the silver halide photographic light-sensitive material of the invention is processed, for example, in a roller transport type automatic developing machine, it is usually processed by being passed through the stages of development and up to drying. In this connection, in order to provide the light-sensitive material with improved drying characteristics and other capabilities, the water content of the material is preferably within the range of 6.0 to 15.0 g/m$^2$, more preferably 9.0 to 14.0 g/m$^2$. In this specification, the expression "water content" means a water content determined by the following method under the conditions of 25° C. and R.H. 75%. That is, samples of 20 cm×20 cm subjected to exposure necessary enough to obtain a maximal density were automatically developed in an automatic developing machine, model KX-500 (with processing velocity changeover switch 90 sec/hr), made by Konishiroku Photo Industry Co. (a schematic diagrammatical arrangement of the machine is shown in FIG. 1). A developer solution comprising "Sakura XD-90" (made by Konishiroku Photo Industry Co.) and a predetermined quantity of starter "XD-90S" (made by company) was used at 35° C., and for a fixing solution, "Sakura new XF" (made by same company) was used at 32° C. For washing water, tap water of 18° C. is supplied at the rate of 3l/min. A drying rack (shown by 92 in FIG. 1) was removed from the automatic developing machine. Samples identical with the one for water content test were cosecutively processed in a total of 101 sheets and at intervals of 1 sheet/12 sec. The 101st sample was used as a water content test sample by fetching same as it came out from a squeeze rack, show by 91 in FIG. 1, and the weight of the sample was measured after 15 seconds. For this purpose, prearrangement was made so that the power supply for the drying system is prevented from being turned on.

The measured weight was taken as $W_w$ (g)

After thoroughly dried, the sample was allowed to stand for not less than one hour under the conditions of 25° C. and 55% RH. Then, the weight of the sample was measured, which was taken as $W_d$ (g) Water content is determined from the following equation.

$$\text{Water content } (g/m^2) = W_w - W_d \times (1000\ cm^2/20\ cm \times 20\ cm)$$

The site for weight measurement must be a place at which the velocity of wind is not more than 0.5 m/sec.

In the photographic light-sensitive material according to the invention, a photographic emulsion layer or other hydrophilic colloidal layer may contain water insoluble or slightly water soluble synthetic polymer dispersions for purspose of providing improved dimensional stability. For example, it is possible to use polymers having as monomeric components thereof alkyl (metha) acrylate, alkoxyalkyl (metha) acrylate, glycidyl (metha) acrylate, (metha) acrylamide, vinyl ester (e.g., vinyl acetate), acrylonitrile, olefin, and stylene, or any combination of these substances; or combinations of these and acrylic acid, methacrylic acid, $\alpha$, $\beta$-unsaturated dicarboxylic acid, hydroxyalkyl (metha) acrylate, sulfoalkyl (metha) acrylate, and styrene sulfonic acid. In the above statement, the expression "(metha) acrylate" represents both acrylate and methacrylate.

The silver halide photographic light-sensitive material according to the invention is preferably provided with a protective layer composed of hydrophilic colloid. For the hydrophilic colloid, those mentioned above are used. The protective layer may be of a monolayer or multilayer structure.

In the silver halide photographic light-sensitive material, its emulsion layer(s) or protective layer—preferably protective layer—may be added with a matting agent and/or a smoothener. For the matting agent, any known material as such may be used, but preferably a polymer matting agent is used which has a mean particle diameter of 0.3–12 μm, preferably 3–9 μm.

Examples of polymer matting agents useful in the practice of the invention are water dispersible vinyl polymers, such as polymethyl metacrylate, and cellulose acetate propinate and starch. More particularly, homopolymers of acrylates, such as methyl methacrylate, glycidyl acrylate, and glycidyl methacrylate, or copolymers of these acrylates or copolymers of them with other vinyl monemers, are preferred as such. More especially, spherical matting agents composed of polymethyl methacrylate and having a mean particle diameter of 3–9 μm are preferred.

A matting agent is added into protective layer above the emulsion layer or layers, for example, into a backside protective layer, but aforesaid polymer matting agent is preferably into the protective layer at the emulsion layer side. In the case where a photographic light-sentitive material containing a polymer matting agent is processed in an automatic developing machine of the roller transport type, for example, the presence of the matting agent eliminates the slipping possibility of the light-sensitive material.

The smoothening agent serves to prevent mutual adhesion of materials, and it is also effective for improvement of frictional characteristics of the light-sensitive material that have an effect on camera fitness during movie film projection. As concrete examples of the smoothening agent, liquid paraffin, waxes, such as esters of higher fatty acids, polyfluorinated hydrocarbons or their derivatives, and silicones, such as polyalkyl polysiloxan, polyaryl polysiloxan, polyalkylaryl polysiloxan, or addition derivatives of alkylene oxides thereof are preferably used.

The light-sensitive material of the invention preferably contains a plasticizer in order to prevent fog during coat drying, or fog and desensitization, etc. due to bending or otherwise under less humid conditions. For the plastisizer, those substances described in, for example, Japanese Patent Publication Open to Public Inspection (herein after referred to as Japanese Patent O.P.I. Publication) No. 63715/1973, Japanese Patent Examined Publication Nos. 4939/1968 and 8745/1972, and U.S. Pat. Nos. 306,470; 2,960,404; 3,412,159; and 3,791,857, may be used, but those containing at least one kind of polyalcohol having at least two hydroxyl groups having a melting point of more than 40° C. are preferred. For such compounds, alcohols having 2 to 12 hydroxyl groups and 2 to 20 carbon atoms, and in which hydroxyl groups are not conjugated with a conjugate chain, or whose oxidized form cannot be written, are preferably used. Further, those having a melting point of 50° C. to less than 300° C. are preferred. Examples of such compound are described in Japanese Patent O.P.I. Publication No. 147449/1987.

In the practice of the inventions, a surface active agent may be used in the light-sensitive material for various purposes.

In this specification, the grain size of the silver halide grains is expressed as a mean value of diametrical lengths calculated on the basis of grains in terms of spheres having volumetric values equivalent to those of individual grains.

Grain diameters can be measured by a centrifugal separation-type Stokes' diameter measuring apparatus, or by an electron microscope.

[EXAMPLES]

The following examples are given to further illustrate the invention. Needless to say, however, it is to be understood that the invention is not limited by the examples.

EXAMPLE 1

In the present Example, regular crystal core grains and light-sensitive emulsions were prepared as follows, and samples were prepared by using them. Evaluation was made of the samples.

(Preparation of Regular Crystal Core Grains)

The solutions of the following compositions were prepared.

| Composition of solution (A) | |
|---|---|
| Ossein gelatin | 30 g |
| Potassium bromide | 1.25 g |
| Nitric acid (0.1 N) | 150 ml |
| Water added to be | 7700 ml |

-continued

| | |
|---|---|
| Composition of solution (B) | |
| Potassium bromide | 6 g |
| Potassium iodide | 0.16 g |
| Water added to be | 740 ml |
| Composition of solution (C) | |
| Potassium bromide | 680 g |
| Potassium iodide | 20 g |
| Water added to be | 2480 ml |
| Composition of solution (D) | |
| Silver nitrate | 8.4 g |
| Nitric acid (0.1 N) | 32 ml |
| Water added to be | 740 ml |
| Composition of solution (E) | |
| Silver nitrate | 991.6 g |
| Nitric acid (0.1 N) | 80 ml |
| Water added to be | 2480 ml |

Solution (A) was poured into a reaction vessel and kept at 62° C. Same was propeller-agitated at 500 rpm. Into the solution were added solution (B) and solution (D) simultaneously but in predetermined quantities over 10 minutes. Then, solution (C) and solution (E) were added simultaneously over a period of 140 minutes. For this purpose, an initial flow rate of addition was controlled to $\frac{1}{8}$ of a final flow rate and linearly increased with time. While these solutions were being added, the pH and pAg were regulated to constant levels of pH=2.0 and pAg=8.3. After addition of the solutions was completed, the pH was increased to 6.0 with sodium carbonate. 150 g of potassium bromide was added, and then excess salts were removed by the precipitation technique using benzene sulfonyl chloride and magnesium sulfate. Gelatin was added to set, and thus a core emulsion was obtained. The core emulsion was a monodispersed silver iodobromide emulsion having cubic crystal grains of 0.32 μm on one side, with a silver iodide content of 2 mol %, the silver iodide grains being octahedral and having a slightly broken angle configuration.

(Preparation of Light-Sensitive Emulsion)

The following solutions were prepared.

| | |
|---|---|
| Composition of solution (I) | |
| Ossein gelatin | 50 g |
| Concentrated ammonia water (28%) | 170 ml |
| Water added to be | 3400 ml |
| Composition of solution (II) | |
| Silver nitrate | 130 g |
| Concentrated ammonia water (28%) | 110 ml |
| Water added to be | 730 ml |
| Composition of solution (III) | |
| Ossein gelatin | 2 g |
| Potassium bromide | 27 g |
| Potassium iodide | 20 g |
| Water added to be | 370 ml |
| Composition of solution (IV) | |
| Silver nitrate | 870 g |
| Concentrated ammonia water | 710 ml |
| Water added to be | 1600 ml |
| Composition of solution (V) | |
| Ossein gelatin | 2 g |
| Potassium bromide | 600 g |
| Water added to be | 1600 ml |
| Composition of solution (VI) | |

-continued

| | |
|---|---|
| Potassium bromide | 500 g |
| Water added to be | 1500 ml |
| Composition of solution (VII) | |
| Potassium iodide | 5 g |
| Water added to be | 50 ml |

Solution (I) was kept at 42° C. and stirred at 500 rpm. Core grains were added by using above prepared core emulsion in a proportion of 3.2% to such amount of such grains obtainable after grain growth. The pH of the solution was adjusted to 9.50 using acetic acid, and then the pAg was adjusted to 7.76 using solution (II). Thereafter, solution (II) and (III) were simultaneously added at an equal flow rate over a period of 30 minutes. Upon completion of the addition, a portion of the emulsion was taken as a sample and X-ray diffraction under Cu-K α rays was made of same by employing JDX-10RA made by JEOL, Ltd., whereby it was confirmed that 30 mol % of silver iodide had been formed. The pH and pAg were adjusted respectively to 8.82 and 8.88 using acetic acid and aqueous solution of potassium bromide. Then, solution (IV) and (V) were added simultaneously over a period of 30 minutes. In this case, the ratio of an initial flow rate and a final flow rate was 1:5, and flow rate was linerly increased with time. The pH was lowered from 8.82 to 8.0 in proportion to the amount of addition of the solution (IV). The emulsion thus obtained was of cubic crystal grain with a total silver iodide content of 2 mol %.

After the temperature was lowered to 40° C. and excess salts were removed by the flocculation precipitation technique using benzene sulfonyl chloride. Gelatin was added to effect setting. This emulsion was taken as E-1.

After the solution (IV) and (V) had been introduced, solution (VI) was added and the in process emulsion was allowed to stand for one minute. An emulsion obtained in same manner as above described was taken as E-2. An emulsion which has been allowed to stand for 5 minutes was taken as E-3, and those to which 5 minutes, 10 minutes, 15 minutes, 20 minutes, and 30 minutes respectively before completion of introduction of the solutions (IV) and (V), quantities of solution (VI) were added were respectively taken as E-4, E-5, E-6, E-7, and E-8.

With respect to samples thus obtained, face index ratios were determined by employing JDX-10RA and according to aforesaid Hirata method. The results are shown in Table 1.

A emultion obtained by adding solution (VII) after completion of addition of other solution compositions in same manner as in E-5 and by being subsequently subjected to 3 minutes agitation was taken as E-9.

(Preparation of Samples)

The obtained emulsions E-1 to E-9 were individually subjected to optimum gold—sulfur sensitization. Immediately before the end of this chemical sensitizations step, 1000 mg/molAg of the following sensitizating dyes were added in the ratio of dye A: dye B=20:1, and further 2.5 g/molAg of 4-hydroxy-6-methyl-1, 3, 3a, 7-tetrazainedene was added.

Spectral sensidizing dye A

-continued

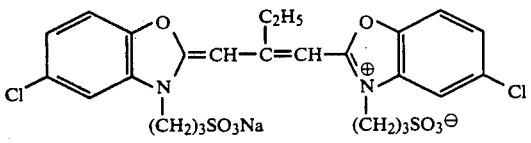

Spectral sensidizing dye B

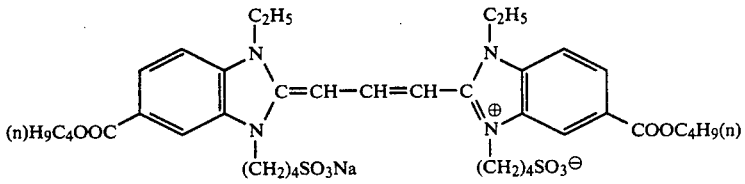

Further, as emulsion layer additives, 400 mg of t-butyl-catechol, 1.0 g of polyvinyl pyrrolidone (molecular weight 10,000), 2.5 g of styrene-maleleic anhydride copolymer, 10 g of trimethylol propane, 5 g of diethylene glycol, 50 mg of nitrophenyl-triphenyl phosphonium chloride, 4 g of 1, 3-dihydroxybenzene-4-ammonium sulfonate, 15 mg of sodium 2-mercaptobenzimidazol-5-sulfonate, 10 mg of 2-mercaptobenzothiazole,

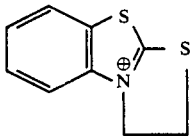

$CH_3SO_3^{\ominus}$ 70 mg

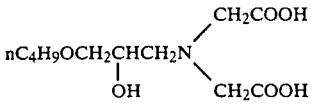

1 g 10 mg of 1, 1-dimethylol-1-brom-1-nitromethane, and 60 mg of

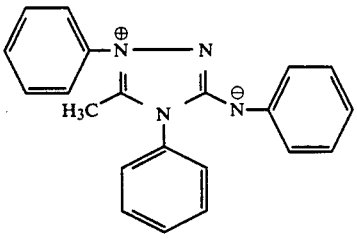

were added to the individual emulsions for each mol of silver halide.

As additives for protective layer, the following compounds were added. That is, 10 mg of

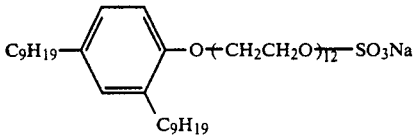

-continued 2 mg of 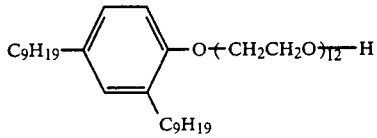

7 mg of 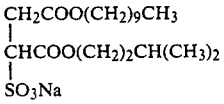

2 mg of $C_9F_{19}-O-(CH_2CH_2O)_{10}-CH_2CH_2OH$ 3 mg of $C_8F_{17}SO_3K$ 15 mg of 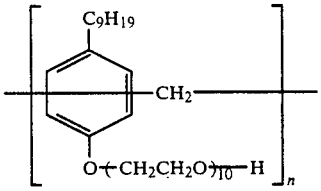

(n represents a mixture of 2–5)

7 mg of a matting agent composed of polymethyl methacrylate having a mean particle diameter of 5 μm, and 70 mg of colloidal silica having a mean particle diameter of 0.013 μm, were added for each gram of gelatin.

Further, as hardners, 10 ml of a 2% aqueous solution of sodium salt of 2-4-dichloro-6-hydroxy-1, 3, 5-triazine, 2 ml of formaline (35%), and 1.5 ml of an aqueous glyoxal solution (40%) were added.

The obtained emulsion and protective layer solution were coated on both sides of a subbed polyethylene terephthalate of 180 μm which had been colored blue. A double-side emulsion coated sheet-formed light-sensitive material was thus obtained. Coating was effected so that the amount of silver present on each side was 1.9 $g/m^2$, with 2 $g/m^2$ of gelatin present in the emulsion layer and 1 $g/m^2$ of gelatin in the protective layer.

(Sensitometric Evaluation)

Each test sample obtained was inserted between intesifying screens KO-250 manufactured by Konishiroku Photo Industry Co., and by employing an aluminum wedge the sample was exposed to X-ray under the conditions of 1–90 KVp, 0.2 sec, and 1 m distance. The obtained sample was developed in a roller automatic developing machine using the following developer and fixing solution, processing being completed in such time as indicated below.

(Developer)

| | |
|---|---|
| Potassium sulfite | 68.75 g |
| Trisodium hydroxyethylethylenediaminetriacetate | 8 g |
| 1,4-dihydroxybenzene | 27 g |
| Boric acid | 10 g |
| 5-methylbenzotriazole | 0.035 g |
| 1-phenyl-5-mercapto tetrazol | 0.015 g |
| Sodium bisulfite | 5.0 g |
| Acetic acid (90%) | 12.8 |
| Triethyleneglycol | 16.0 g |
| 1-phenyl-3-pyrazolidone | 1.2 g |
| 5-nitroindazole | 0.14 g |
| 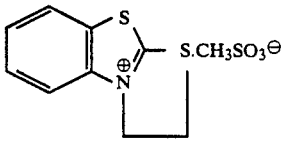 | 0.001 g |
| Glutaraldehyde | 4.30 g |
| Disodium ethylenediaminetetraacetate | 2.0 g |
| Potassium bromide | 4.0 g |
| 5-nitrobenzoimidazol | 0.9 g |

The ingredients were prepared into 1 l of aqueous solution, the pH of which was adjusted to 10.30 with potassium hydroxide.

(Fixer)

| | |
|---|---|
| Sodium thiosulfate pentahydrate | 45 g |
| Disodium ethylenediaminetetraacetate | 0.5 g |
| Ammonium thiosulfate | 140 g |
| Anhydrous sodium sulfite | 7.3 g |
| Potassium acetate | 15.5 g |
| Aluminum sulfate, 10–18 hydrate | 27.7 g |
| Sulfuric acid (50 wt %) | 6.0 g |
| Citric acid | 0.9 g |
| Boric acid | 7.0 g |
| Glacial acetic acid | 5.1 g |

The ingredients were prepared into 1 l of aqueous solution, the pH of which was adjusted to pH 4.0 with glacial acetic acid.

(Processing Stages)

| | Processing temp | Processing time |
|---|---|---|
| Loading | — | 1.2 sec |
| Developing + interfacing | 35° C. | 14.6 sec |
| Fixing + interfacing | 33° C. | 8.2 sec |
| Washing + interfacing | 25° C. | 7.2 sec |
| Squeegee | 40° C. | 5.7 sec |
| Drying | 45° C. | 8.1 sec |
| Total | — | 45.0 sec |

In the present Example, an automatic developing machine as shown in FIG. 1 was employed. Rubber rollers were used as rollers for the machine. Rollers for the interfacing portions of the machine were of silicone rubber with a hardness of 48 degrees, and those for processing bath interior portions were of EDPM with a hardness of 46 degrees, a kind of ethylene-propylene rubber. Each roller had a surface roughness of Dmax=4 μm. The total number of rollers was 84, of which 6 rollers were located at the developing section. The number of opposed rollers to the total number of rollers was 51/84≈0.61. The developer was replenished at the rate of 33 ml/quarter and the fixed was replenished at the rate of 63 ml/quarter. The amount of water required for washing was 1.5 l/min. The air flow for drying was 11 $m^3$/min. For heating, a heater having a capacity of 3 kW (200 V) was employed. In FIG. 1, numeral 1 designates a film loader; 2 is a film basket; 3 is a control panel; 31 is a remote control receiver unit; 4 designates rollers; 5 is a transport path; 6 is a developing bath; 7 is a fixing bath; 8 is a washing bat; 9 is a drying rack; and 91 is a squeegee rack.

The total period of time taken for processing was 45 sec as above mentioned.

On the basis of a characteristic curve obtained with respect to each sample, an X-ray relative exposure amount at base density+fog density+1.0 was determined, from which was calculated relative sensitivity value.

The results obtained are shown in Table 1.

(Preparation of Corner Cut Samples)

Coated samples were cut to a rectangular size of 24 cm×30 cm. Samples of E-1 to E-9, each in lots of 10, were randomly piled up with dummy films to a total of 1000 and cut at a corner by a circular blade to give a round corner having a curvature radius of 1 cm. Thus, corner cut samples were prepared. These samples were developed in aforesaid developing machine, and were then visually evaluated as to how they were blackened at their respective corner cut portions. In evaluation rating, 1 means: blackened and unserviceable;
2: better than rating 1 but yet unserviceable;
3: serviceable;
4: slightly blackened; and
5: non-blackened. In Table 1, 10-sheet averages are shown.

(Integrated Evaluation)

As Table 1 indicates, samples according to the invention exhibitted high sensitivity and, in respect of corner cut, they were rated higher than 3.

TABLE 1

| Sample No. | Emulsion No. | Face index ratio $\frac{(111)}{(111)+(100)} \times 100$ | Configuration | X-ray sensitivity | Corner cut evaluation | Remarks |
|---|---|---|---|---|---|---|
| 1 | E-1 | 0 | Regularly hexahedral | 100 | 2.1 | Non-invention |
| 2 | E-2 | 5 | Regularly hexahedral slightly rouded off | 98 | 2.5 | Non-invention |
| 3 | E-3 | 11 | Slightly round | 115 | 4.3 | Invention |
| 4 | E-4 | 25 | Tetradecahedral | 125 | 4.2 | Invention |
| 5 | E-5 | 54 | Tetradecahedral | 130 | 4.2 | Invention |

TABLE 1-continued

| Sample No. | Emulsion No. | Face index ratio $\frac{(111)}{(111)+(100)} \times 100$ | Configuration | X-ray sensitivity | Corner cut evaluation | Remarks |
|---|---|---|---|---|---|---|
| 6 | E-6 | 73 | Tetradecahedral | 128 | 4.3 | Invention |
| 7 | E-7 | 81 | Tetradecahedral | 130 | 4.2 | Invention |
| 8 | E-8 | 100 | Regularly octahedral | 128 | 4.2 | Invention |
| 9 | E-9 | 58 | Tetradecahedral | 140 | 4.3 | Invention |

EXAMPLE 2

In conjunction with the preparation of No. 5 samples in Example 1, adjustment was made with respect to the gelatin in both the protective layer and the emulsion layer, and thus samples as shown in Table 2 were prepared. Tests similar to those in Example 1 and water content measurements according to the earlier described procedure were carried out with the samples.

It is noted that sample Nos. 17, 18, and 19 in which the amount of gelatin exceeded the limit specified by the invention did not dry at 23° C. and 60% RH and had the trouble of poor drying.

TABLE 2

| Sample No. | Emulsion No. | Gelatin (g/m²) Protective layer | Emul layer | Total | X-ray sensitivity | Corner cut evaluation | Water cont g/m² | Remarks (drying ability) |
|---|---|---|---|---|---|---|---|---|
| 1 | E-1 | 1 | 2 | 3 | 100 | 2.1 | 12.1 | (Dry) Non-invention |
| 5 | E-5 | 1 | 2 | 3 | 130 | 4.2 | 12.3 | (Dry) Invention |
| 10 | E-5 | 0.7 | 0.8 | 1.5 | 148 | 1.2 | 6.1 | (Dry) Invention |
| 11 | E-5 | 0.7 | 1.1 | 1.8 | 142 | 1.5 | 6.4 | (Dry) Invention |
| 12 | E-5 | 0.8 | 1.3 | 2.0 | 138 | 3.1 | 7.5 | (Dry) Invention |
| 13 | E-5 | 1 | 1.2 | 2.2 | 135 | 3.2 | 8.2 | (Dry) Invention |
| 14 | E-5 | 1 | 1.8 | 2.8 | 134 | 3.8 | 10.1 | (Dry) Invention |
| 15 | E-5 | 1.2 | 2.0 | 3.2 | 128 | 4.2 | 13.3 | (Dry) Invention |
| 16 | E-5 | 1.2 | 2.3 | 3.5 | 128 | 4.5 | 14.2 | (Dry) Invention |
| 17 | E-5 | 1.2 | 2.4 | 3.6 | 115 | 4.5 | 15.3 | (Poor dry) Non-invention |
| 18 | E-5 | 1.2 | 2.6 | 3.8 | 110 | 4.5 | 16.5 | (Poor dry) Non-invention |
| 19 | E-5 | 1.2 | 2.8 | 4.0 | 105 | 4.5 | 20.3 | (Poor dry) Non-invention |

EXAMPLE 3

A core emulsion was grown according to the Example 1 procedure and, by using a proportion thereof corresponding to 12% of a total emulsion, emulsion grains were grown in same manner as in E-5. Thus, an emulsion having a mean grain diameter of 0.65 μm was obtained. This emulsion was numbered E-10. E-5 emulsion that has undergone the process of up to chemical sensitization and E-10 emulsion were mixed in a weight ratio of 3:1. Tests were carried out in same manner as earlier described. Results were substantially same as was the case with sample No. 5.

EXAMPLE 4

The following solutions of the following compositions were prepared.

| | |
|---|---|
| Composition of solution (F) | |
| Ossein gelatin | 80 g |
| Potassium bromide | 150 g |
| Water added to be | 5000 ml |
| Composition of solution (G) | |
| Potassium bromide | 700 g |
| Water added to be | 3000 ml |
| Composition of solution (H) | |
| Potassium iodide | 488 g |
| Water added to be | 1500 ml |
| Composition of solution (I) | |
| Silver nitrate | 1000 g |
| Water added to be | 3000 ml |

Solution (F) was kept at 60° C., and meanwhile solutions (G) and (H) were introduced into the solution (F) at varied mixture ratios simultaneously with solution (I) over a period of time of 30 minutes.

Figure 2:
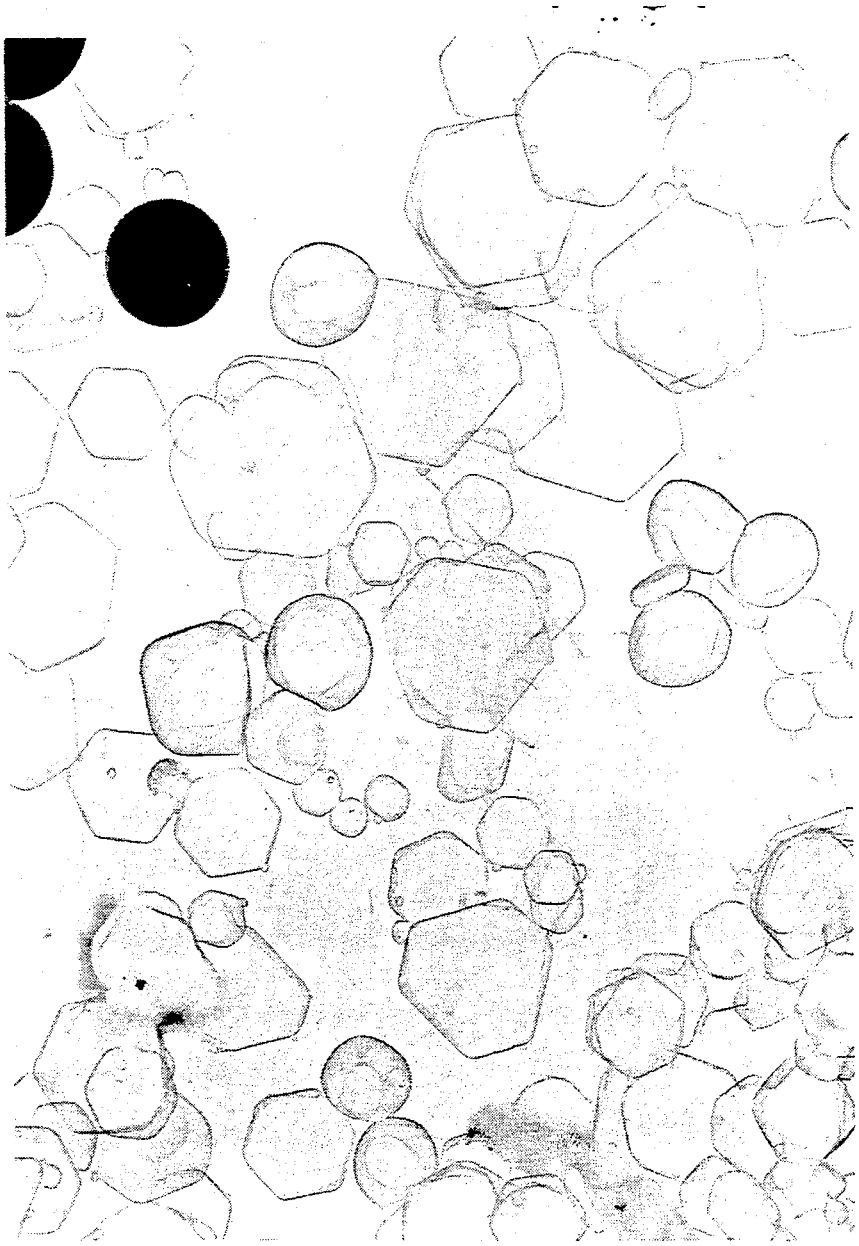
FIG. 2 is an electron photomicrographic representation showing by way of example a grain appearance of grains according to the invention as obtained in one example of the invention.

Emulsions thus obtained were of a twin crystal grain configuration having (111) face with a mean grain diameter intesifying screens KO-250 manufactured by Konishiroku Photo of approximately 0.9 μm. The twin crystal core emulsions individually had silver iodide contents as indicated in Table 3. In same manner as in Example 1, these emulsions were desalinated and then the emulsions each, as a core, was dispersed again in the solution (F), whereby a second phase coating was made. In this case, too, solutions (G) and (H) were added at varied mixture ratios to give different silver iodide contents. Grains obtained were all multi-disperse silver iodobromide twin crystall grains of 100% (111) face. With respect to grains used in sample No. 24 in Table 3, an electromicroscopic view of its grain configuration is shown in FIG. 2.

In same manner as in Example 1, these grains were chemically sensitized and made into test samples, except that 15 g of trimethylol propane was used, and tests were carried out. The results are shown in Table 3.

Samples according to the invention showed satisfactory results in both sensitivity and corner cut rating.

TABLE 3

| Sample No. | Twin crystal core AgI mol % | Surface phase AgI mol % | Difference between internal phase and outermost phase in AgI mol % | Overall grain diameter AgI mol % | Mean sensitivity (μ) | X-ray cut rating | Corner | Remarks |
|---|---|---|---|---|---|---|---|---|
| 20 | 0.5 | 0 | 0.5 | 0.45 | 1.01 | 50 | 1.8 | Non-invention |
| 21 | 1.0 | 0 | 1.0 | 0.90 | 1.02 | 85 | 3.2 | Invention |
| 22 | 1.0 | 0.5 | 0.5 | 0.95 | 1.00 | 87 | 2.3 | Non-invention |
| 23 | 2 | 0 | 2 | 1.80 | 1.01 | 98 | 3.8 | Invention |
| 24 | 2 | 0.5 | 1.5 | 1.85 | 1.04 | 102 | 3.6 | Invention |
| 25 | 2 | 1 | 1.0 | 1.90 | 1.03 | 105 | 3.5 | Invention |
| 26 | 2 | 1.5 | 0.5 | 0.95 | 0.98 | 95 | 2.2 | Non-invention |
| 27 | 4 | 0 | 4 | 3.60 | 0.99 | 130 | 4.2 | Invention |
| 28 | 4 | 0.3 | 3.7 | 3.63 | 0.99 | 135 | 4.3 | Invention |
| 29 | 8 | 0 | 8 | 7.2 | 1.00 | 150 | 3.8 | Invention |
| 30 | 8 | 0.3 | 7.3 | 7.23 | 1.02 | 155 | 3.5 | Invention |

As above described, the sheet-form light-sensitive material of the invention is highly light-sensitive and, even if its corners are cut to an obtuse angled or rounded configuration, it can inhibit occurrence of pressure fog along the cut corner line. Further, the light-sensitive material is well suited for ultra-rapid processing, for example, processing by an automatic developing machine in a period of 20 to not more than 60 seconds, and is capable of inhibiting such pressure fog occurrence when it is subjected to such rapid processing.

What is claimed is:

1. A sheet of silver halide photographic light-sensitive material adapted for processing by an automatic processor in 20 seconds to less than 60 seconds, said sheet including a support and component layers on a side of said support, said component layers comprising a light-sensitive layer containing silver halide grains, each of said grains having a surface area and at least an outer phase and an inner phase contiguous thereto, said outer phase having at least one mol % less silver iodide than said inner phase, 10% to 100% of said surface area being a (III) face, said component layers having a total gelatin content of 2.0 g/m$^2$ to 3.5 g/m$^2$, and a water content, after processing and before drying, of 6.0 g/m$^2$ to 15. g/m$^2$;

said sheet being cut at its corners at an obtuse angle or rounded.

2. The sheet claim 1, wherein whole silver iodide content of said silver halide grain is not more than 8 mol %.

3. The sheet of claim 1, wherein silver iodide content of the phase having the highest silver iodide content in said silver halide grain is within the range of from 10 mol % to 40 mol %.

4. The sheet of claim 1, wherein said silver halide grain is grown under a condition of pAg of not less than 10.5.

5. The sheet of claim 4, wherein said condition of pAg is not less than 11.5.

6. The sheet of claim 1, wherein said amount of gelatin is within the range of from 2.40 g/m$^2$ to 3.30 g/m$^2$.

7. The sheet of claim 6, wherein said amount of gelatin is within the range of from 2.50 g/m$^2$ to 3.15 g/m$^2$.

8. The sheet of claim 1, wherein water content of said component layers after processing and before drying is within the range of from 9.0 g/m$^2$ to 14.0 g/m$^2$.

9. A process for manufacturing a sheet of silver halide photographic light sensitive material comprising a step for cutting a corner of said sheet to an obtus angled or rounded configuration, wherein said sheet of silver halide photographic material comprised of a light-sensitive layer, provided on a support, containing a silver halide grain composed of at least two phases and the silver iodide content of outermost phase is at least 1 mol % lower than that of inside phase contiguous to said outermost phase, and 10% to 100% of surface area of said silver halide grain is occupied with (111) face, and the total gelatin amount of component layers on the same side of the support including said light-sensitve layer is within the range of from 2.0 g/m$^2$ to 3.5 g/m$^2$.

10. The method for processing a sheet of silver halide photographic light-sensitive material by an automatic processor in a period of time of 20 seconds to less than 60 seconds, wherein said silver halide photographic light-sensitve material is comprised of a light-sensitive layer, provided on a support, containing a silver halide grain composed of at least two phases and the silver iodide content of outermost phase is at least 1 mol % lower than that of inside phase contiguous to said outermost phase, and 10% to 100% of surface area of said silver halide grain is occupied with (111) face, and the total gelatin amount of component layers on the same side of the support including said light-sensitive layer is within the range of from 2.0 g/m$^2$ to 3.5 g/m$^2$ said sheet being cut at its corners at an obtuse angle or rounded.

* * * * *